United States Patent [19]

Chevallier et al.

[11] Patent Number: 4,837,583

[45] Date of Patent: Jun. 6, 1989

[54] DEVICE FOR ADJUSTING THE POLARIZATION OF AN ANTENNA AND A METHOD FOR THE PRACTICAL APPLICATION OF SAID DEVICE

[75] Inventors: René Chevallier, Paris; Jean Fouillet, Mesnil Le Roi, both of France

[73] Assignee: Alcatel Thomson Faisceaux Hertizens, France

[21] Appl. No.: 16,161

[22] Filed: Feb. 18, 1987

[30] Foreign Application Priority Data

Feb. 18, 1986 [FR] France ..... 86 02170

[51] Int. Cl.[4] ..... H01Q 3/12

[52] U.S. Cl. ..... 343/760; 343/761; 343/894

[58] Field of Search ..... 343/761, 786, 840, 839, 343/894, 760, 781 R, 756

[56] References Cited

U.S. PATENT DOCUMENTS

| | | | |
|---|---|---|---|
| 3,786,472 | 1/1974 | Scopacasa | 340/689 |
| 4,085,375 | 4/1978 | Galuschak et al. | 328/160 |
| 4,178,574 | 12/1979 | Edens et al. | 343/756 |
| 4,654,670 | 3/1987 | Fleming | 343/892 |

FOREIGN PATENT DOCUMENTS

| | | | |
|---|---|---|---|
| 0026001 | 4/1981 | European Pat. Off. . | |
| 2812341 | 9/1979 | Fed. Rep. of Germany . | |
| 74342 | 7/1978 | Japan | 343/840 |
| 83/03243 | 9/1983 | World Int. Prop. O. . | |

*Primary Examiner*—William L. Sikes
*Assistant Examiner*—Michael C. Wimer
*Attorney, Agent, or Firm*—Sughrue, Mion, Zinn, Macpeak & Seas

[57] ABSTRACT

A device for adjusting the polarization of a rotatable-feed antenna with respect to a reference plane makes use for an angular reference device located near the feed-horn aperture. The angular reference device consists of a tilting mercury switch having spaced contacts bridged by a mass of mercury and rigidly fixed to the feed horn. The adjusting device includes a connector located at the rear of the antenna in a zone which is accessible for adjustment and a multiple-conductor cable establishing an electrical connection between the contacts and the connector in order to provide an electrical link between the angular reference device and a visual display device.

3 Claims, 4 Drawing Sheets

DEVICE FOR ADJUSTING THE POLARIZATION OF AN ANTENNA AND A METHOD FOR THE PRACTICAL APPLICATION OF SAID DEVICE

BACKGROUND OF THE INVENTION

1. Field of the Invention

The present invention relates to a device for adjusting the polarization of an antenna and to a method for the practical application of said device.

2. Description of the Prior Art

Antennas of the type employed in radio links, for example, are expected to achieve standards of performance which are becoming constantly higher. One particular requirement which has to be satisfied is accurate adjustment of polarization with respect to a vertical plane, this adjustment operation being carried out by rotating the primary feed. To this end, the angular rotation reference must imperatively be taken from the feed-horn aperture.

This adjustment of verticality of polarization can be performed very simply by means of a level placed on a reference face located at the rear end of the feed when this latter is accessible, which is not always the case.

Independently of its lack of accessibility, the above-mentioned angular reference may be totally inaccessible for adjustment purposes.

These drawbacks can effectively be overcome by means of the present invention.

SUMMARY OF THE INVENTION

Accordingly, the invention proposes a device for adjusting the polarization of a rotatable-feed antenna with respect to a reference plane by making use of an angular reference device located near the feed-horn aperture. The invention is distinguished by the fact that the angular reference device is a tilting mercury switch having spaced mercury contacts closed by a mass of mercury and rigidly fixed to the feed horn and that said adjusting device includes a connector located at the rear of the antenna in a zone which is accessible for adjustment and a multiple-conductor cable for establishing an electrical connection between said contacts and the connector in order to connect the reference device electrically to a visual display device.

In more precise terms, the tilting switch employed is a three-contact switch which is linked with the connector by means of a three-conductor cable.

The invention proposes in addition a method for the practical application of a device of this type involving two successive steps :

a first step during which the feed is rotated in one direction in order to ensure that a first pair (or set) of the three contacts of the tilting switch is closed and that a second pair (or set) of the three contacts is opened;

a second step during which the feed is rotated at very low speed in the other direction, the position sought being the angular position which corresponds to opening of the first set of contacts and to closing of the second set of contacts.

DETAILED DESCRIPTION OF THE INVENTION

Figure 1:
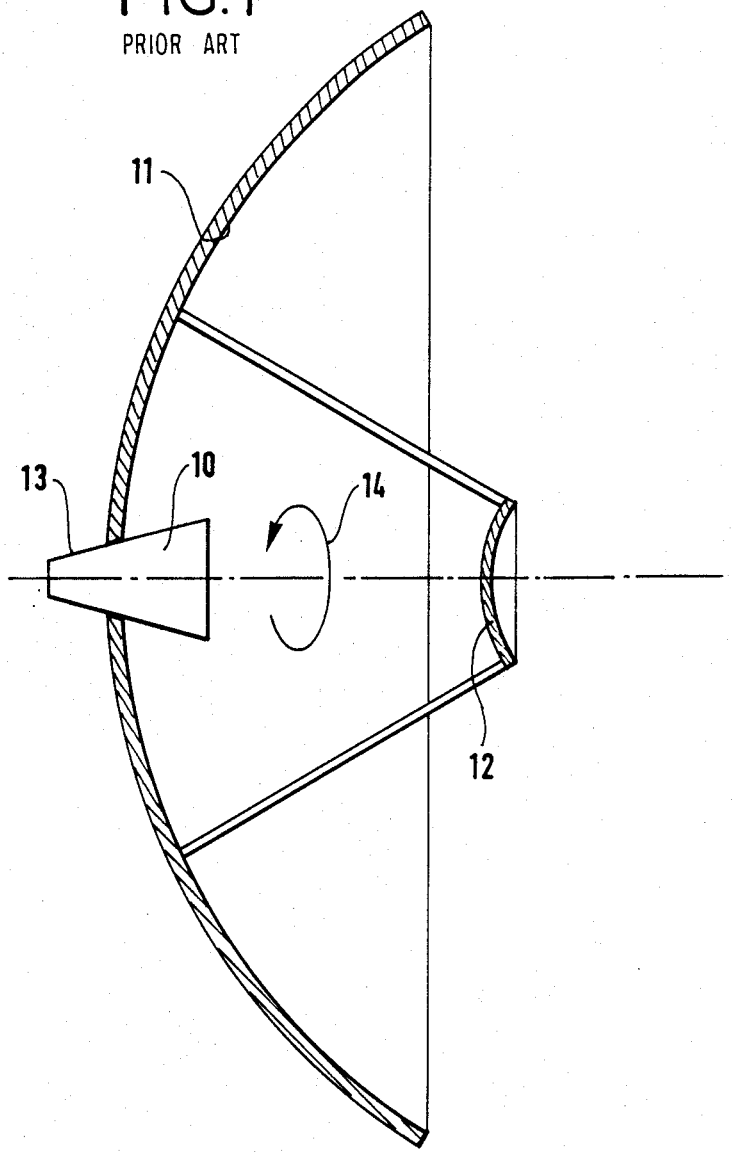
FIG.1 PRIOR ART
FIGS. 1 and 2 are schematic diagrams illustrating two first types of antennas of the prior art.

In the case of an antenna of the Cassegrain type shown in FIG. 1, the feed 10 is located at the vertex of the main reflector 11, an auxiliary reflector 12 being also shown in the figure.

Said feed 10 is of small length and has high rigidity, the supply portion of said feed being directly accessible at the rear of the antenna. Under these conditions, adjustment of vertically of polarization can be performed very simply by means of a level placed on a reference face 13 at the rear end of said feed 10 by rotating this latter in the direction 14.

Figure 2:
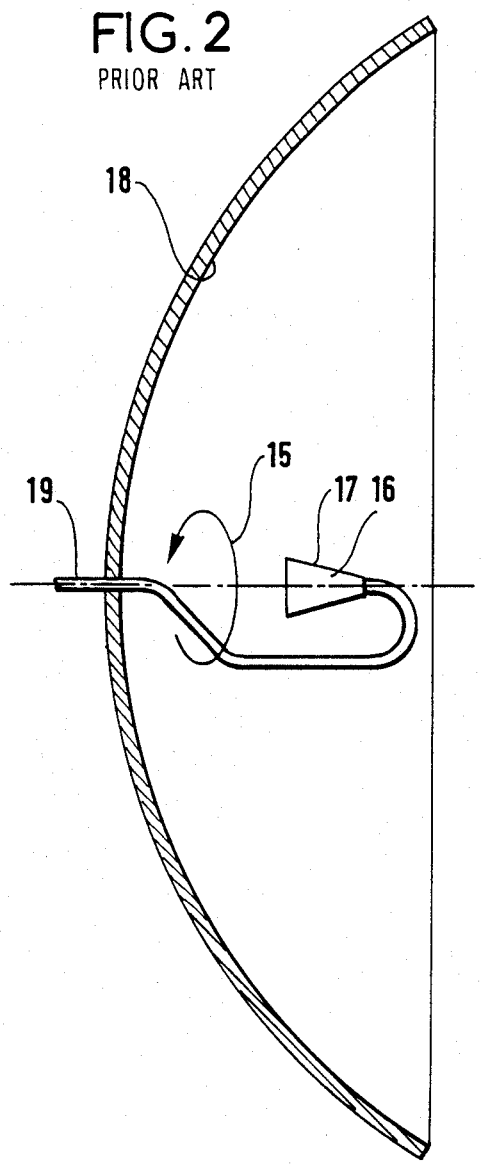
FIG. 2 PRIOR ART

The same ease of adjustment is not found, however, in the case of antennas with feed 16 placed at the focus such as the antennas shown in FIG. 2.

For practical reasons of accessibility, it must always be possible for the feed 16 (such as a feed of the so-called gooseneck type shown in this figure) to be driven in rotation (15) at the rear of the antenna. On the other hand, the angular reference 17 relating to verticality of polarization must remain at the focus of the reflector 18 and cannot be mechanically transferred with precision to the adjustment point 19.

Figure 3:
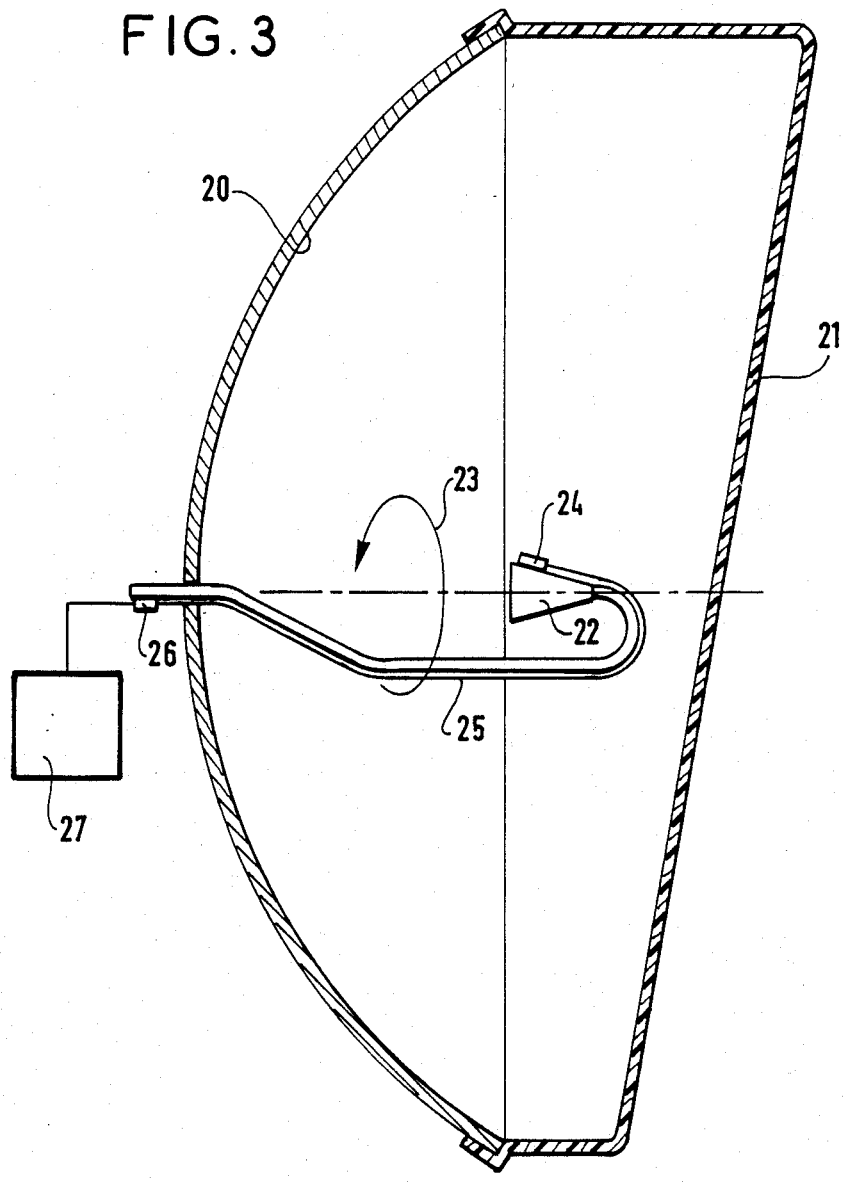
FIG. 3 is a schematic diagram illustrating a third type of antenna of the prior art and equipped with the device in accordance with the invention.

Independently of its lack of accessibility, the angular reference may be totally invisible from the adjustment point 19, which is the case of a radomed antenna as illustrated in FIG. 3. An antenna of this type has a main reflector 20 provided with a radome 21 and a feed 22 of the gooseneck type considered here. This feed is capable of rotational displacement in the direction of the arrow 23.

The device in accordance with the invention makes it possible to adjust with respect to the vertical plane the polarization of a feed which is inaccessible materially and/or visually. The device in accordance with the invention in fact comprises an angular reference device which is a tilting mercury switch 24 with mass of mercury 32 capable of bridging given sets of contacts A, B, C, FIG. 4, and installed near the aperture of the feed-horn 22, the angular orientation of which is to be adjusted.

Figure 4:
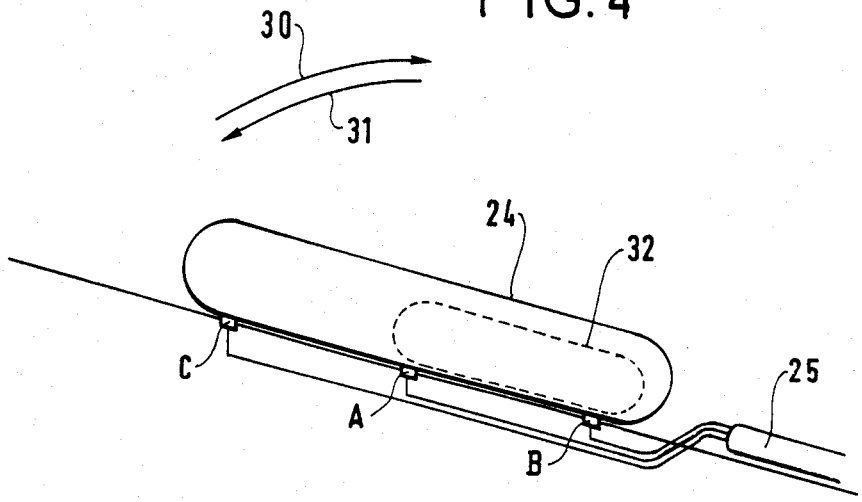
FIG. 4 illustrates the operation of the device in accordance with the invention.

The tilting switch 24 as shown in FIG. 4 is of low cost, is integrated to the feed-horn 22 and is angularly on the horn at the point of assembly.

The three output terminals of spaced contacts A, B, C of the tilting mercury switch 24 are connected by means of a three-conductor cable 25 to a connector 26 located at the rear of the antenna in a zone which is accessible for adjustment. At this location, detection of short-circuiting between respective terminals of given pairs of contacts A, B, C of the tilting mercury switch 24 can be carried out very simply by means of a visual display device 27 which can be an ohmmeter or even an electric torch or flashlight with external contacts.

With reference to FIG. 4, the adjustment operation is carried out as follows:

in a first step, the feed horn 22 to which the tilting switch 24 is rigidly fixed is caused to rotate in the positive direction 30 in order to ensure overstepping of the vertical position. It is then ascertained that the set of contacts AB is closed and that the set of contacts AC is open;

in a second step, the feed horn 22 is rotated at very low speed in the negative direction 31. The position sought is the angular position which corresponds to opening of the set of contacts AB and to closing of the set of contacts AC by shift of mercury 32 from the position shown to one bridging contacts AC.

In the event of troublesome vibrations of the antenna as a result of very strong wind squalls, the operations described in the foregoing can be begun again several times in order to optimize the result.

It will be readily understood that the foregoing description of the present invention as illustrated in the accompanying drawings has been given solely by way of preferential example and that its constituent elements can be replaced by equivalent elements without thereby departing either from the scope or the spirit of the invention.

Thus the adjusting device of the invention has been considered for use with the antenna shown in FIG. 3 but could just as readily have been employed with the antenna shown in FIG. 2.

What is claimed is:

1. An adjusting device for adjusting the polarization of a rotatable-feed antenna having a front and a rear with respect to a reference plane, said adjusting device including an angular position detecting means located near a feed horn aperture at the front of the antenna for indicating a desired angular position of said feed horn, wherein said angular position detecting means is a tilting mercury switch having a mass of mercury selectively bridging spaced contacts defining outputs, said tilting switch being rigidly fixed to the feed horn, and wherein said adjusting device further includes a connector located at the rear of the antenna in a zone which is accessible for adjustment and a multiple-conductor cable electrically connecting said contact outputs of said tilting mercury switch and the connector in order to electrically connect the angular position detecting means to a visual display device to facilitate adjustment of the feed horn to said desired angualr position, the polarization of said antenna depending upon the angular position of the feed horn which is inaccessible materially and/or visually.

2. An adjusting device according to claim 1, wherein said tilting mercury switch comprises a three-contact switch including three-outputs linked with the connector by means of a three-conductor cable constituting said multiple-conductor cable.

3. A method of adjusting the polarization of a rotatable-feed antenna having a front and a rear with respect to a reference plane via an angular reference device located near a feed-horn aperture at the front of the antenna and comprising a tilting mercury switch having a mass of mercury selectively bridging spaced contacts defining outputs, a connector located at the rear of the antenna in a zone which is accessible for adjustment and a multiple-conductor cable electrically connecting said contact outputs of the tilting mercury switch and the connector in order to electrically connect the reference device to a visual display device, said method comprising:

in a first step, rotating a rotatable feed in one direction in order to ensure that a first set of contacts of the tilting switch is closed and that a second set of contacts of said switch is opened; and in a second step, rotating said feed at a very low speed in the opposite direction, whereby the position sought is the angular position which corresponds to the opening of the first set of contacts and the closing of the second set of contacts.

* * * * *